US008292119B2

(12) United States Patent
Kenneally

(10) Patent No.: US 8,292,119 B2
(45) Date of Patent: Oct. 23, 2012

(54) COOLER BOX

(76) Inventor: Keith A. Kenneally, South San Francisco, CA (US)

( * ) Notice: Subject to any disclaimer, the term of this patent is extended or adjusted under 35 U.S.C. 154(b) by 523 days.

(21) Appl. No.: 12/693,630

(22) Filed: Jan. 26, 2010

(65) Prior Publication Data

US 2011/0180550 A1 Jul. 28, 2011

(51) Int. Cl.
*B65D 83/72* (2006.01)

(52) U.S. Cl. ..... 220/592.26; 220/4.29; 220/592.2; 220/315; 220/752; 53/440; 53/467; 53/468

(58) Field of Classification Search ..... 220/4.29, 220/315, 592.2, 592.26, 752; 53/440, 467, 53/468

See application file for complete search history.

(56) References Cited

U.S. PATENT DOCUMENTS 2,621,847 A 12/1952 Stephanich
3,864,936 A 2/1975 Frank et al.
5,134,858 A 8/1992 Abbondanzo
5,215,248 A 6/1993 Moser
5,622,276 A 4/1997 Simmons
6,401,479 B2 6/2002 Garrett
7,334,684 B1 2/2008 Fontanilla et al.
2005/0279124 A1* 12/2005 Maldonado ..... 62/457.7
2006/0021376 A1* 2/2006 Scroggs ..... 62/457.7
2008/0217330 A1* 9/2008 Baum ..... 220/23.83

* cited by examiner

*Primary Examiner* — Anthony Stashick
*Assistant Examiner* — Elizabeth Volz

(57) ABSTRACT

The disclosure describes an airtight cooler box having a base panel, a collapsible unitary side panel, and a top panel. The base panel extends orthogonally from the base to form an opening defined by side panel top edges. A top panel having pouches on an inside surface is sized fit the top opening. A rigid base plate rests on a base panel inside surface. A top plate with vent openings is located inside the container under the top panel. Zippered closures on three top edges of the side panel and corresponding top panel three edges close the box. Box inner and outer surfaces include a poly-vinyl chloride material bonded to an aluminum laminate with multiple layers of foam interposed between panel inner and outer surfaces.

12 Claims, 3 Drawing Sheets

COOLER BOX

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to preserving produce. More particularly, the invention is related to a thermally insulated, collapsible container used to package and store perishable goods during transport by ground, air or sea so as to preserve the temperature of, and prevent heat damage and chill injury to, the goods while in transit and to deliver the produce at a desired temperature.

BACKGROUND OF THE INVENTION

Several methods and associated apparatus for protecting produce during transport have been used including insulated cargo quilts, refrigerated carts, plastic wrapped pallets, vacuum and the like. These methods and related apparatus either include dedicated, one-time use materials or hardware items that are bulky and difficult to return for re-use or re-shipment.

Further, these methods and associated apparatus are limited in the thermal insulation qualities and as such are unsuitable for extended transport logistics which may include off-loading to land based delivery transportation.

The cooler box relates to insulated containers which are collapsible for smaller storage or shipping for reuse. A collapsible insulated cooler box breaks down to allow it to be stored or boxed and shipped, by having some or all of the container sidewalls and sidewall edges foldable to collapse and fit within the container bottom and top surfaces. Rigid portions of the cooler box likewise are capable of being contained within the container bottom and top surfaces and collapsed side walls.

A further objective of the cooler box is to provide a lightweight and durable produce container capable of keeping product at a desired temperature from point of shipping to point of delivery.

Yet another principal objective of the cooler box is to provide an efficient and inexpensive design, from the stand point of both the cost of the materials and the quantity of materials used in manufacture of the cooler box. The cooler box is also easy to manufacture. Additionally, the cooler box is readily assembled such that thermal problems are minimized during set-up and use of the cooler box.

Another objective of the cooler box is to provide a container sized to conveniently and economically house a plurality of produce packs arranged in a three-dimensional array within the cooler box enclosure, and provide uniform thermal stability for the produce packs from a point of shipping the produce packs to a point of receiving the produce packs.

DISCLOSURE OF INVENTION

An airtight cooler box 10 having a base panel 20, a collapsible unitary side panel 24 sized and folded to extend orthogonally from the base panel 20 to form an enclosure with a top opening defined by the side panel top edges. A top panel 28 is included, the top panel 28 sized and folded on an edge to extend orthogonally from the unitary side panel 24 and further sized for top panel 28 three edges to fit the top opening, the top panel 28 further comprising a plurality of pouches 40 positioned on an inside surface. A rigid base plate 22 is included, the rigid base plate 22 being sized to cover the base panel 20 when the rigid base plate 22 is positioned inside the container resting on a base panel inside surface. The cooler box 10 further includes a rigid top plate 32 having a plurality of vent openings 36 through the rigid top plate 32 corresponding to the pouches 40 positioned on the top panel 28 inside surface and sized to be located inside the container under the top panel 28 inside surface. A zipper closure 50 on three top edges of the side panel and corresponding top panel three edges allows the cooler box 10 to be closed upon the product contents. The base panel 20, side panel 24 and top panel 28 further comprise inner surfaces 16 and outer surfaces 12 of a poly-vinyl chloride material bonded to an aluminum laminate with multiple layers of foam 14 interposed between the inner surfaces 16 and outer surfaces 12.

BRIEF DESCRIPTION OF DRAWINGS

The above stated features, aspects, and advantages of the cooler box will become better understood with regard to the following description and accompanying drawings as further described.

BEST MODE FOR CARRYING OUT THE INVENTION

Figure 1:
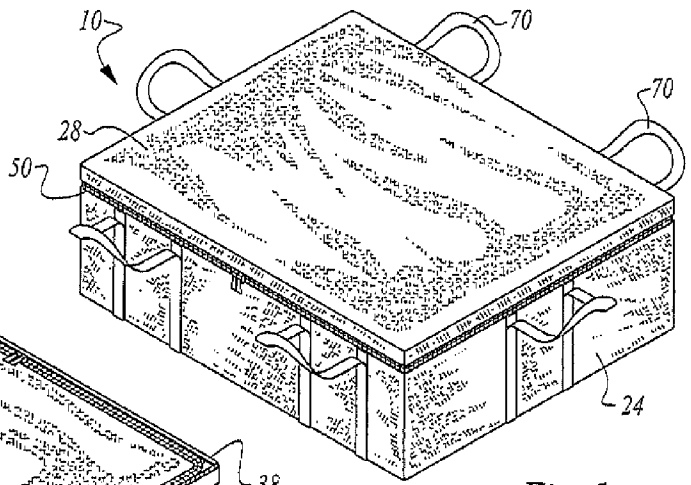
FIG. 1 is a perspective view of an embodiment of cooler box 10 depicting the top panel 28 zippered closed onto the collapsible unitary side panel 24.
Figure 2:
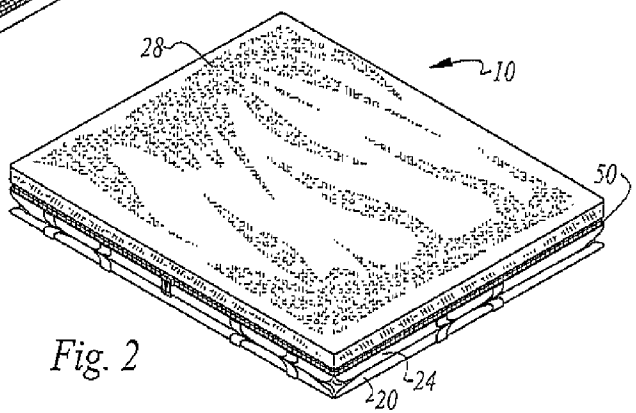
FIG. 2 is a perspective view of the embodiment of cooler box 10 of FIG. 1 depicting the cooler box in an empty, collapsed position.
Figure 3:
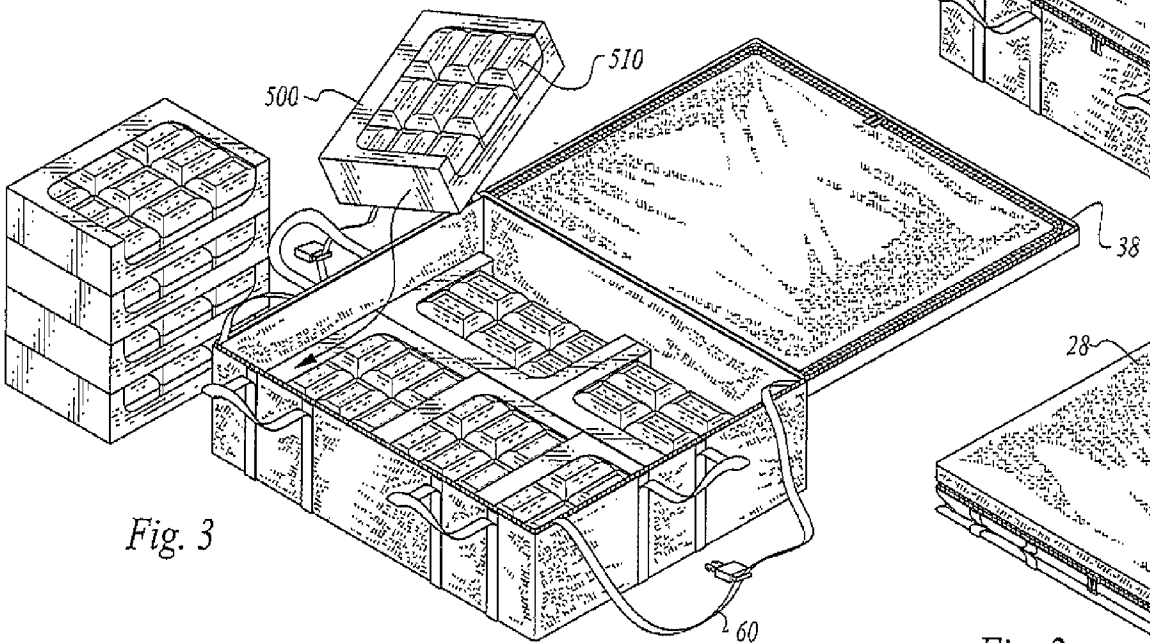
FIG. 3 is a perspective view of the embodiment of cooler box 10 of FIG. 1 depicting an array of produce boxes 500, each of which contains an array of produce packs 510, being loaded into the cooler box enclosure.
Figure 4:
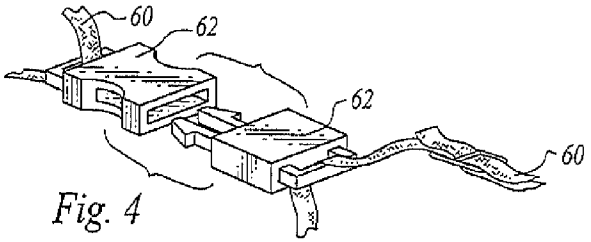
FIG. 4 is a perspective view of bayonet closure 62 of the internal security straps of the embodiment of cooler box 10 of FIG. 3.
Figure 5:
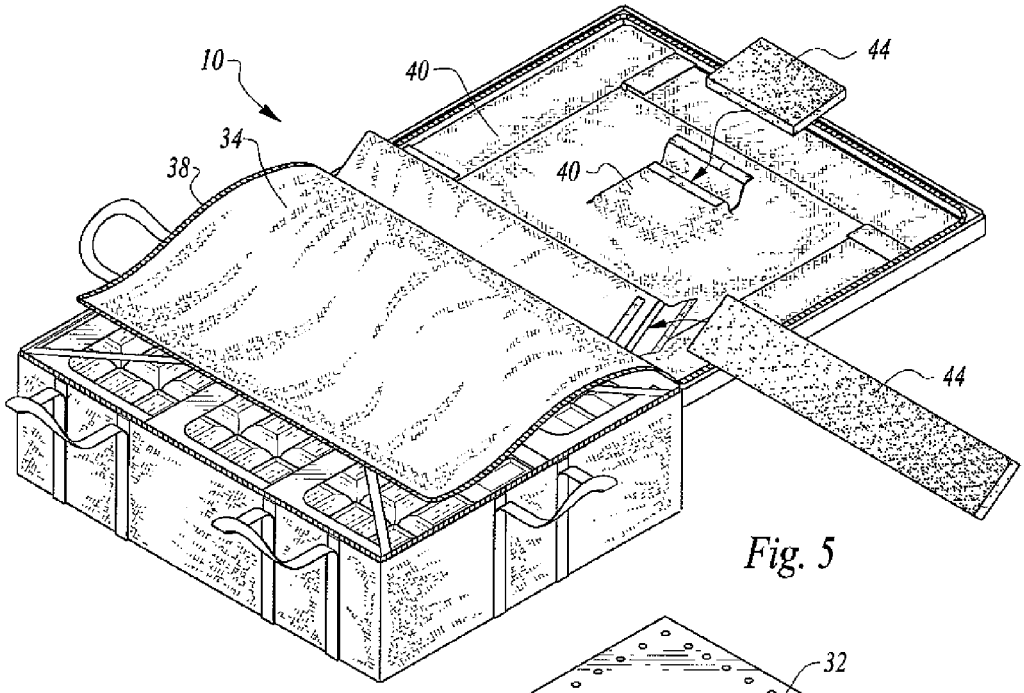
FIG. 5 is a perspective view of the embodiment of cooler box 10 of FIG. 3 depicting the top panel compartment 34 open to allow insertion of dry ice blocks 44 into top panel pouches 40.
Figure 6:
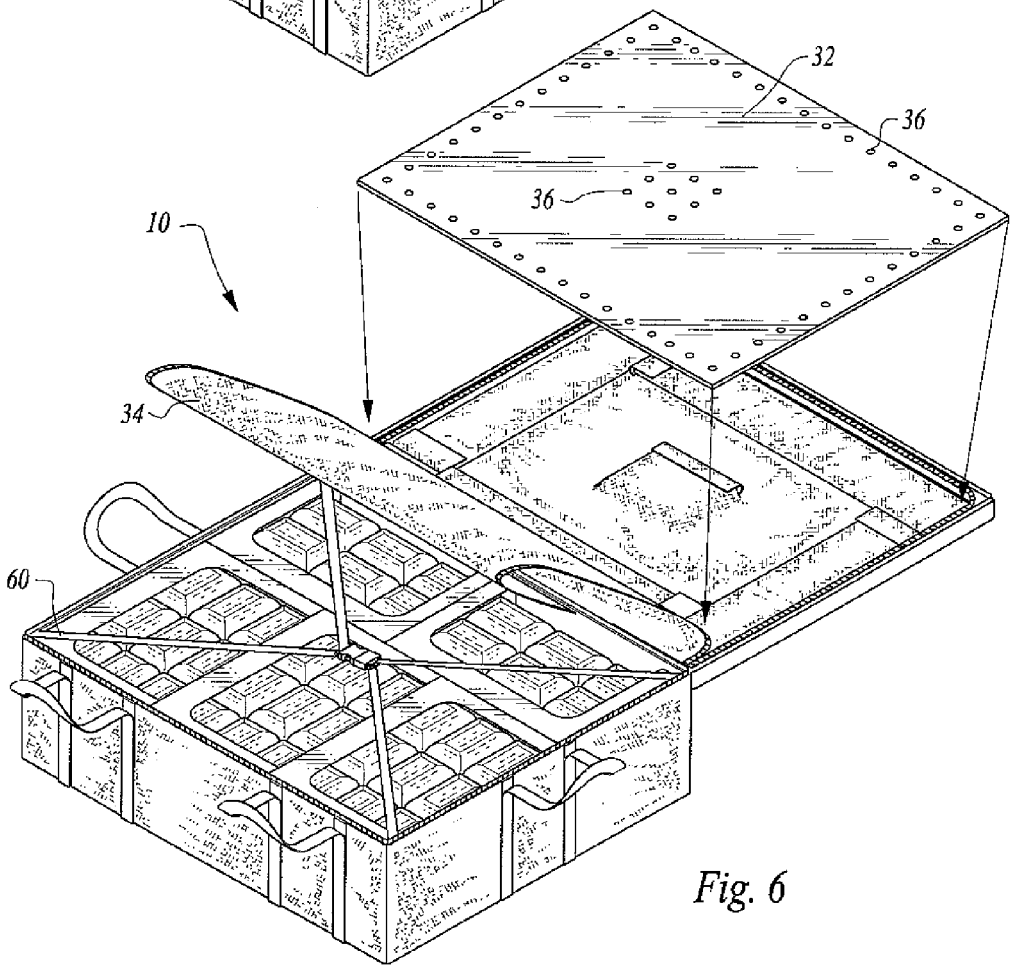
FIG. 6 is a perspective view of the embodiment of cooler box 10 of FIG. 5 depicting the top panel compartment 34 open to allow insertion of the top panel rigid plate 32 so that upon zipper closure 38 of the top panel compartment 34 and closure of the cooler box, the top panel rigid plate 32 is positioned between the packs of dry ice 44 within the top panel pouches 40 and the arrays of produce boxes 500 and produce packs 510.
Figure 7:
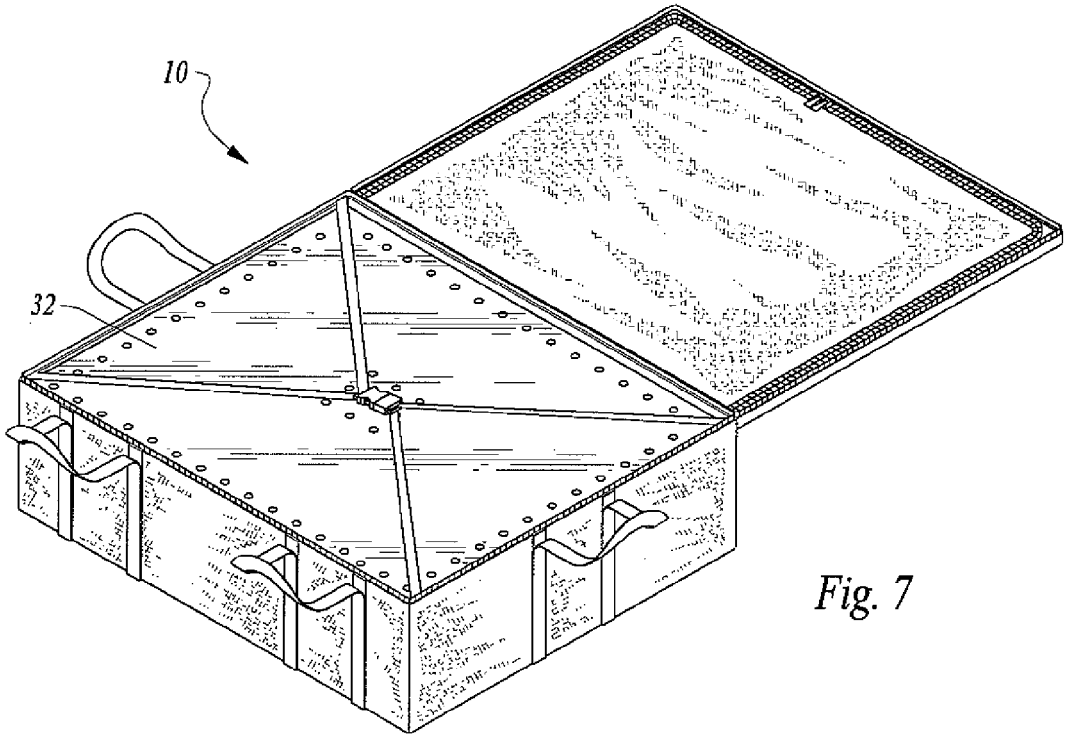
FIG. 7 is a perspective view of an embodiment of cooler box 10 where insertion of the top panel rigid plate 32 is directly on top of the produce packs 510 so that upon zipper closure 50 of the top panel compartment 34 to the collapsible unitary side panel 24, the top panel rigid plate 32 is positioned between the packs of dry ice within the top panel and the arrays of produce boxes 500 and produce packs 510.
Figure 8:
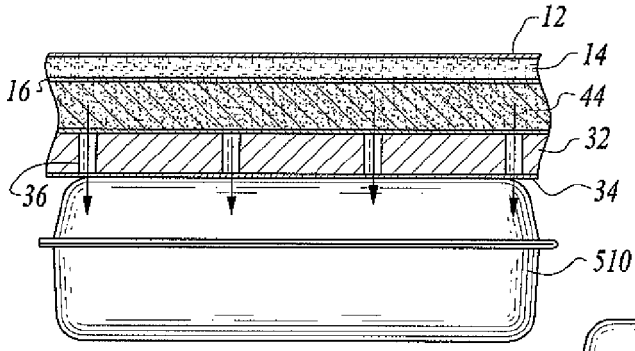
FIG. 8 is a side view of the dry ice 44 and top panel rigid plate 32 is positioned between the packs of dry ice 44 within the top panel pouches 40 and the arrays of produce boxes 500 and produce packs 510 for the embodiment of cooler box 10 of FIGS. 1-6.

Referring more specifically to the drawings, for illustrative purposes the cooler box 10 is embodied generally in FIGS. 1-10. It will be appreciated that the cooler box may vary as to configuration and as to the details of the parts, and that the method of using the cooler box 10 may vary as to details and to the order of steps, without departing from the basic concepts as disclosed herein. The cooler box 10, and a system and method of use thereof, are disclosed generally. However, the disclosed cooler box 10, plus the system and method for using the box cooler, may be used in a variety of applications, as will be readily apparent to those skilled in the art.

A method of packaging and preserving produce for air transport includes the steps of: a) packing the produce in an airtight cooler box 10 container in which the produce is to be transported; and b) providing means for maintaining the temperature of the produce in the cooler box 10 container to the point of delivery.

The method is practiced by further providing the airtight cooler box 10 container. An embodiment of the method includes an airtight cooler box 10 container which includes, in combination a base panel 20, a collapsible unitary side panel 24, and a top panel 28. Each of these three panels have inner surfaces 16 and outer surfaces 12 including a poly-vinyl chloride material bonded to an aluminum laminate and further including multiple layers of foam 14 interposed between the inner 16 and outer surfaces 12.

The collapsible unitary side panel 24 is sized and folded to extend orthogonally from the base panel 20 to form an enclosure around the base panel 20. The enclosure around the base panel 20 includes a top opening defined by the side panel 24 top edges.

The top panel 28 is sized and folded on an edge to extend orthogonally from the unitary side panel 24. The top panel 28 is further sized for three top panel edges to fit the top opening defined by the side panel 24 top edges. The top panel 28 further includes a plurality of pouches 40 positioned on a top panel surface corresponding to the enclosure around the base panel 20.

Figure 9:
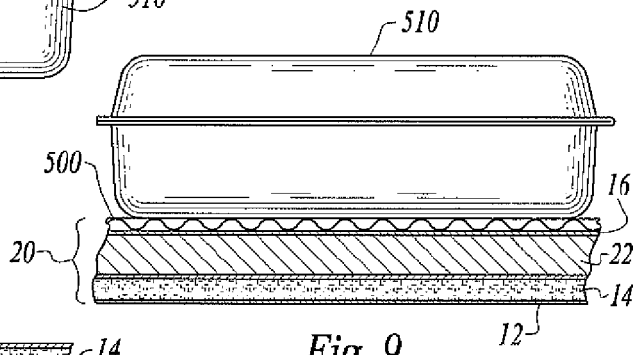
FIG. 9 is a side view of bottom panel rigid plate 22 is positioned between the base panel 48 and the arrays of produce boxes 500 and produce packs 510 for an embodiment of cooler box 10.
Figure 10:
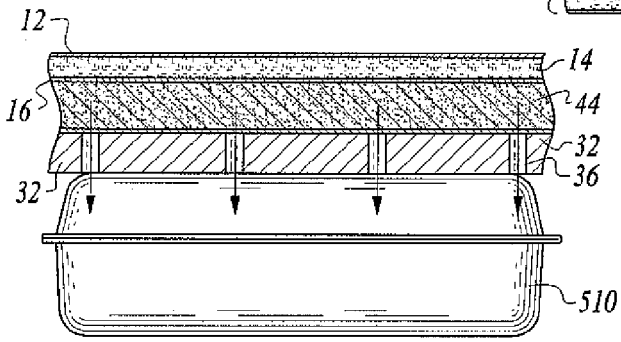
FIG. 10 is a side view of the dry ice 44 and top panel rigid plate 32 is positioned between the packs of dry ice 44 within the top panel pouches 40 and the arrays of produce boxes 500 and produce packs 510 for the embodiment of cooler box 10 of FIG. 7.

A rigid base plate 22 is sized to cover the base panel 20 and is positioned inside the container resting on a base panel 20 inside surface 16 at the bottom of the cooler box 10 enclosure and opening defined by the side panel top edges, FIG. 9.

A rigid top plate 32 having a plurality of vent openings 36 through the top plate 32 corresponding to the position of pouches 40 is positioned on the top panel 28 inside surface 16 and sized to be located inside the cooler box 10 container enclosure 34 under the top panel 28 inside surface 16 when a plurality of pre-packaged, vented produce containers 500, each of which contains an array of produce packs 510, are fitted as an array within the airtight transport cooler box 10 container enclosure. The temperature of the airtight transport cooler box 10 container enclosure and the enclosed produce containers is maintained by placing at least one block of dry ice 44 within each top panel 28 pouch 44.

An airtight zipper closure 50 is positioned on three top edges of the side panel 24 and corresponding top panel 28 three edges.

Internal security straps 60 are provided with a bayonet 62 or similar secure closure within the enclosure to secure the plurality of pre-packaged, vented produce containers 500, each of which contains an array of produce packs 510, are fitted as an array within the airtight transport container enclosure.

The airtight cooler box 10 container further comprises at least one external handle 70.

An embodiment of the airtight cooler box 10 container includes a second zipper closure 38 on the top panel 28 surface corresponding to the airtight enclosure. The second zipper closure 38 is sized to provide a zippered enclosure within the top panel to contain the plurality of pouches 40 and rigid top plate 28, wherein the pouches 40 are positioned above the rigid top plate 28 in relation to the airtight cooler box 10 enclosure.

Therefore, the foregoing is considered as illustrative only of the principles of the apparatus, system and method for a refrigerated shipping container used to package and store perishable goods during transport by ground, air or sea so as to preserve the temperature of, and prevent heat damage and chill injury to, the goods while in transit. Additionally, since numerous modifications and changes will readily occur to those skilled in the art, it is not desired to limit the apparatus, system and method for a refrigerated shipping container used to package and store perishable goods during transport by ground, air or sea so as to preserve the temperature of, and prevent heat damage and chill injury to, the goods while in transit to the exact construction and operation shown and described, and further, all suitable modifications and equivalents may be resorted to, falling within the scope of the disclosed apparatus, system and method.

I claim:

1. A collapsible insulated container comprising:

a) a base panel;

b) a collapsible unitary side panel sized and folded to extend orthogonally from the base panel to form an enclosure around the base panel comprising a top opening defined by the side panel top edges, whereby the enclosure is sized to receive a plurality of pre-packaged vented produce containers;

c) a top panel sized and folded on an edge to extend orthogonally from the unitary side panel, and further sized for three edges to fit the top opening, the top panel further comprising a plurality of pouches positioned on a top panel surface corresponding to the enclosure;

d) a rigid base plate sized to cover the base panel and positioned inside the container resting on a base panel inside surface;

e) a rigid top plate having a plurality of vent openings through the top plate corresponding to the position of pouches positioned on the top panel inside surface and sized to be located inside the container under the top panel inside surface; and f) a zipper closure on three top edges of the side panel and corresponding top panel three edges providing an airtight container enclosure when the top panel is zippered to the top edges of the side panel;

wherein the base panel, side panel and top panel further comprise inner and outer surfaces comprising a poly-vinyl chloride material bonded to an aluminum laminate and further comprising multiple layers of foam interposed between the inner and outer surfaces.

2. The container of claim 1, further comprising at least one external handle.

3. The container of claim 1, further comprising a second zipper closure on the top panel surface corresponding to the airtight enclosure sized to provide a zippered enclosure within the top panel sized to contain the plurality of pouches and rigid top plate, wherein the pouches are positioned above the rigid top plate in relation to the airtight enclosure.

4. The container of claim 1, further comprising internal security straps within the airtight enclosure.

5. The container of claim 4, further comprising at least one bayonet closure to tie the internal security straps down onto the packed produce within the airtight container in which the produce is to be transported.

6. A method of packaging and preserving produce for air transport, the method comprising the steps of:

a) providing an assembly for maintaining the temperature of produce in an airtight container to a point of delivery by air transport, the assembly comprising in combination:
   1) a base panel;
   2) a collapsible unitary side panel sized and folded to extend orthogonally from the base panel to form an enclosure around the base panel, the enclosure comprising a top opening defined by the side panel top edges;
   3) a top panel sized and folded on an edge to extend orthogonally from the unitary side panel, and further sized for three top panel edges to fit the top opening, the top panel further comprising a plurality of pouches positioned on a top panel inside surface corresponding to the enclosure;
   4) a rigid base plate sized to cover the base panel and positioned inside the container resting on a base panel inside surface;
   5) a rigid top plate having a plurality of vent openings through the top plate corresponding to the position of pouches positioned on the top panel inside surface and sized to be located inside the container under the top panel inside surface;
   6) an airtight zipper closure on three top edges of the side panel and corresponding top panel three edges;
   7) internal security straps within the enclosure, the straps comprising at least one bayonet closure; and
   8) at least one external handle;

wherein the base panel, side panel and top panel further comprise inner and outer surfaces comprising a polyvinyl chloride material bonded to an aluminum laminate and further comprising multiple layers of foam interposed between the inner and outer surfaces;

b) providing at least one piece of dry ice in each of the pouches;

c) packing the produce in the airtight container;

d) securing the packed produce within the container with the security straps and bayonet closure; and e) closing the container.

7. The method of packaging and preserving produce for air transport of claim 6, wherein the top panel further comprises a zipper closure on the top panel inside surface sized to provide a zippered enclosure within the top panel sized to contain the plurality of pouches and rigid top plate, wherein the pouches are positioned between the rigid top plate and the top panel inside surface.

8. The method of claim 6, wherein step c) packing the produce in the airtight container further comprises the steps of:

a) pre-packaging the produce in a plurality of vented containers; and b) securing the plurality of pre-packaged vented produce containers within the airtight transport container enclosure.

9. Apparatus to package and store perishable goods during transport to preserve the temperature of, and prevent heat damage and chill injury to, the goods while in transit, the apparatus comprising:

a) a base panel;

b) a collapsible unitary side panel sized and folded to extend orthogonally from the base panel to form an enclosure comprising a top opening defined by the side panel top edges, whereby the enclosure is sized to receive a plurality of pre-packaged vented produce containers;

c) a top panel sized and folded on an edge to extend orthogonally from the unitary side panel, and further sized for three edges to fit the top opening, the top panel further comprising a plurality of pouches positioned on a top panel surface corresponding to the enclosure;

d) a rigid base plate sized to cover the base panel and positioned inside the container resting on a base panel inside surface;

e) a rigid top plate having a plurality of vent openings through the top plate corresponding to the position of pouches positioned on the top panel inside surface and sized to be located inside the container under the top panel inside surface; and f) a zipper closure on three top edges of the side panel and corresponding top panel three edges providing an airtight container enclosure when the top panel is zippered to the top edges of the side panel;

g) internal security straps within the airtight enclosure;

h) at least one bayonet closure affixed to the security straps to secure packed produce within the airtight container in which the produce is to be transported under the I internal security straps;

i) at least one external handle; and j) a second zipper closure on the top panel surface corresponding to the airtight enclosure sized to provide a zippered enclosure within the top panel sized to contain the plurality of pouches and rigid top plate, wherein the pouches are positioned above the rigid top plate in relation to the airtight enclosure;

wherein the base panel, side panel and top panel further comprise inner and outer surfaces comprising a polyvinyl chloride material bonded to an aluminum laminate and further comprising multiple layers of foam interposed between the inner and outer surfaces.

10. A method of packaging and preserving produce for air transport, the method comprising the steps of:

a) providing an assembly for maintaining the temperature of produce in an airtight container to a point of delivery by air transport, the assembly comprising in combination:
   1) a base panel;
   2) a collapsible unitary side panel sized and folded to extend orthogonally from the base panel to form an enclosure around the base panel, the enclosure comprising a top opening defined by the side panel top edges;
   3) a top panel sized and folded on an edge to extend orthogonally from the unitary side panel, and further sized for three top panel edges to fit the top opening, the top panel further comprising a plurality of pouches positioned on a top panel inside surface corresponding to the enclosure;

4) a rigid base plate sized to cover the base panel and positioned inside the container resting on a base panel inside surface;

5) a rigid top plate having a plurality of vent openings through the top plate corresponding to the position of pouches positioned on the top panel inside surface and sized to be located inside the container under the top panel inside surface; and 6) an airtight zipper closure on three top edges of the side panel and corresponding top panel three edges;

wherein the base panel, side panel and top panel further comprise inner and outer surfaces comprising a polyvinyl chloride material bonded to an aluminum laminate and further comprising multiple layers of foam interposed between the inner and outer surfaces;

b) providing at least one piece of dry ice in each of the pouches;

c) packing the produce in the airtight container; and d) closing the container.

11. A method of packaging and preserving produce for air transport, the method comprising the steps of:

a) providing an assembly for maintaining the temperature of produce in an airtight container to a point of delivery by air transport, the assembly comprising in combination:

1) a base panel;

2) a collapsible unitary side panel sized and folded to extend orthogonally from the base panel to form an enclosure around the base panel, the enclosure comprising a top opening defined by the side panel top edges;

3) a top panel sized and folded on an edge to extend orthogonally from the unitary side panel, and further sized for three top panel edges to fit the top opening, the top panel further comprising a plurality of pouches positioned on a top panel inside surface corresponding to the enclosure;

4) a rigid base plate sized to cover the base panel and positioned inside the container resting on a base panel inside surface;

5) a rigid top plate having a plurality of vent openings through the top plate corresponding to the position of pouches positioned on the top panel inside surface and sized to be located inside the container under the top panel inside surface;

6) an airtight zipper closure on three top edges of the side panel and corresponding top panel three edges; and 7) internal security straps within the enclosure;

wherein the base panel, side panel and top panel further comprise inner and outer surfaces comprising a polyvinyl chloride material bonded to an aluminum laminate and further comprising multiple layers of foam interposed between the inner and outer surfaces; and b) providing at least one piece of dry ice in each of the pouches;

c) packing the produce in the airtight container;

d) securing the packed produce within the container with the security straps; and e) closing the container.

12. A method of packaging and preserving produce for air transport, the method comprising the steps of:

a) providing an assembly for maintaining the temperature of produce in an airtight container to a point of delivery by air transport, the assembly comprising in combination:

1) a base panel;

2) a collapsible unitary side panel sized and folded to extend orthogonally from the base panel to form an enclosure around the base panel, the enclosure comprising a top opening defined by the side panel top edges;

3) a top panel sized and folded on an edge to extend orthogonally from the unitary side panel, and further sized for three top panel edges to fit the top opening, the top panel further comprising a plurality of pouches positioned on a top panel inside surface corresponding to the enclosure;

4) a rigid base plate sized to cover the base panel and positioned inside the container resting on a base panel inside surface;

5) a rigid top plate having a plurality of vent openings through the top plate corresponding to the position of pouches positioned on the top panel inside surface and sized to be located inside the container under the top panel inside surface;

6) an airtight zipper closure on three top edges of the side panel and corresponding top panel three edges;

7) internal security straps within the enclosure; and 8) at least one external handle;

wherein the base panel, side panel and top panel further comprise inner and outer surfaces comprising a polyvinyl chloride material bonded to an aluminum laminate and further comprising multiple layers of foam interposed between the inner and outer surfaces; and b) providing at least one piece of dry ice in each of the pouches;

c) packing the produce in the airtight container;

d) securing the packed produce within the container with the security straps; and e) closing the container.

* * * * *